US007191574B2

(12) United States Patent
Malini

(10) Patent No.: US 7,191,574 B2
(45) Date of Patent: Mar. 20, 2007

(54) MACHINE FOR WRAPPING GROUPS OF PRODUCTS WITH TUBULAR LENGTHS OF STRETCH FILM

(75) Inventor: Massimo Malini, Bologna (IT)

(73) Assignee: Aetna Group, S.p.A., Rimini (IT)

( * ) Notice: Subject to any disclaimer, the term of this patent is extended or adjusted under 35 U.S.C. 154(b) by 28 days.

(21) Appl. No.: 11/112,887

(22) Filed: Apr. 22, 2005

(65) Prior Publication Data

US 2005/0235613 A1 Oct. 27, 2005

(30) Foreign Application Priority Data

Apr. 23, 2004 (IT) ..... BO2004A0253

(51) Int. Cl.
*B65B 53/00* (2006.01)
*B65B 21/14* (2006.01)
*B65B 21/24* (2006.01)

(52) U.S. Cl. ..... 53/48.3; 53/134.1; 53/556; 53/585

(58) Field of Classification Search ..... 53/556, 53/48.2–48.4, 134.1, 170, 176, 582, 585, 53/567, 575, 576, 398, 441; *B65B 21/14, B65B 21/24*

See application file for complete search history.

(56) References Cited

U.S. PATENT DOCUMENTS 3,479,930 A * 11/1969 Peppler ..... 53/556
4,403,463 A * 9/1983 Danti ..... 53/585
4,495,751 A 1/1985 Galbiati
4,514,966 A * 5/1985 Konstantin ..... 53/585
6,619,014 B2 * 9/2003 Muller ..... 53/588
6,751,931 B2 6/2004 Cere'
6,922,980 B2 * 8/2005 Cere' ..... 53/556
2003/0024213 A1 2/2003 Cere'

FOREIGN PATENT DOCUMENTS

| | | |
|---|---|---|
| EP | 0 442 111 | 8/1991 |
| EP | 1 314 647 | 5/2003 |
| FR | 2.203.354 | 4/1974 |
| IT | 01285827 | 6/1998 |

OTHER PUBLICATIONS

European Search Report dated Oct. 31, 2005 corresponding to EP 05 42 5250.

* cited by examiner

*Primary Examiner*—Stephen F. Gerrity
(74) *Attorney, Agent, or Firm*—Fay Sharpe LLP

(57) ABSTRACT

A machine for wrapping groups of products (7) in tubular lengths of stretch film (4) comprises a rotating carousel (1) equipped with a plurality of wrapping units (2) having bars (3) for holding and stretching to size a succession of tubular film lengths (4) fed to a station (S1) and for placing the stretched tubular film lengths (4) around respective groups of products (7) to be wrapped fed one after the other.

26 Claims, 9 Drawing Sheets

MACHINE FOR WRAPPING GROUPS OF PRODUCTS WITH TUBULAR LENGTHS OF STRETCH FILM

BACKGROUND OF THE INVENTION

The present invention addresses the sector of packaging groups of products by wrapping them in tubular film lengths.

This invention relates in particular to the sector of packaging with stretch film, where the film is not heated but applied cold, stretched over the groups of products to be wrapped and left to return to its original size, thanks to its elastic properties, to form individual packs in which the products are held together tightly.

At present, machines for stretch wrapping groups of products are well known. These machines typically comprise several operating stations designed to receive groups of products and to wrap each group with a length of stretch film.

In particular, patent IT1285827 to the same Applicant as the present discloses a machine and a method for wrapping groups of products in tubular stretch film lengths.

The machine described in that patent comprises a station for feeding tubular film lengths to a stretching device where a set of reciprocally mobile parallel rods engage the tube of film lengthwise.

After receiving the film, the stretching device moves towards a placing station and, while doing so, stretches the tube of film to the size and shape matching that of the group of products waiting to be wrapped at the placing and unloading station.

At this station, the group of products is inserted into the tube which, on being released by the bars, tends to return to its original size over the group of products in such a way as to form a pack which is then unloaded.

More particularly, this type of machine has a revolver-like structure comprising a plurality of stretching devices arranged in a circle and made to move one after the other first through the feed station and then through the placing and unloading station.

A machine designed in this way has the advantage of offering high productivity in a limited space and making a continuous flow of packages whose formation is synchronized with the feeding of the film tubes to the placing station and hence with the speed of carousel rotation.

The disadvantage of the solution described above, however, is that the carousel has to bear the full weight of the actuators necessary for fully stretching the film, which considerably complicates and encumbers the machine structure, especially if the machine has two or more stretching units.

A first aim of the present invention is to overcome the above mentioned disadvantage by providing a high productivity machine with a relatively simple structure.

SUMMARY OF THE INVENTION

In accordance with the invention, this aim is achieved by a machine as defined in the main appended claim.

The advantages achieved consist essentially in reducing the number of actuators necessary for fully stretching the film and, in particular, the number of actuators that move with the carousel.

Another advantage is the possibility of using more powerful actuators without increasing the weight to be moved.

Yet another advantage is that completing the stretching step at a dedicated station makes it possible to carry out other operations on the length of film while it is being transferred to the placing station after it has been stretched to size.

Other results and advantages are achieved in a machine according to the dependent claims.

Further advantages are achieved by the independent movement of the stretching bars in at least two directions (preferably horizontal and vertical), which provides better control of the power required to stretch the film and makes it possible to better adapt to the dimensional characteristics of the products.

In addition, the stretching bars may be advantageously guided in the vertical direction by straight guides and/or guides with cam-like profile, extending for the whole or part of the circumference of the carousel and engaged directly or indirectly with the bars that move with the carousel.

In this solution, an active contribution to the stretching of the film may also be provided by the guide profiles acting in conjunction with the rotation of the carousel. This makes it possible to reduce the number of actuators necessary for stretching and positioning the bars (and the length of film) during operations.

The presence of these guides also facilitates the accuracy of positioning relative to a carousel loading/unloading table, not only when the length of film is placed around the group of products to be wrapped but also when the package formed is unloaded from the carousel.

Yet another advantageous feature of a machine according to the appended claims is the possibility of having at least two carousels connected, for example, by a conveyor belt so that a group of products can be wrapped successively by two (or more) lengths of film at a defined angle from each other, thus improving the stability of the package.

In this case, the outer wrap can be used to make a handle by which the package can be carried.

BRIEF DESCRIPTION OF THE DRAWINGS

The technical characteristics of the invention, with reference to the above objects, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENTS

Figure 1:
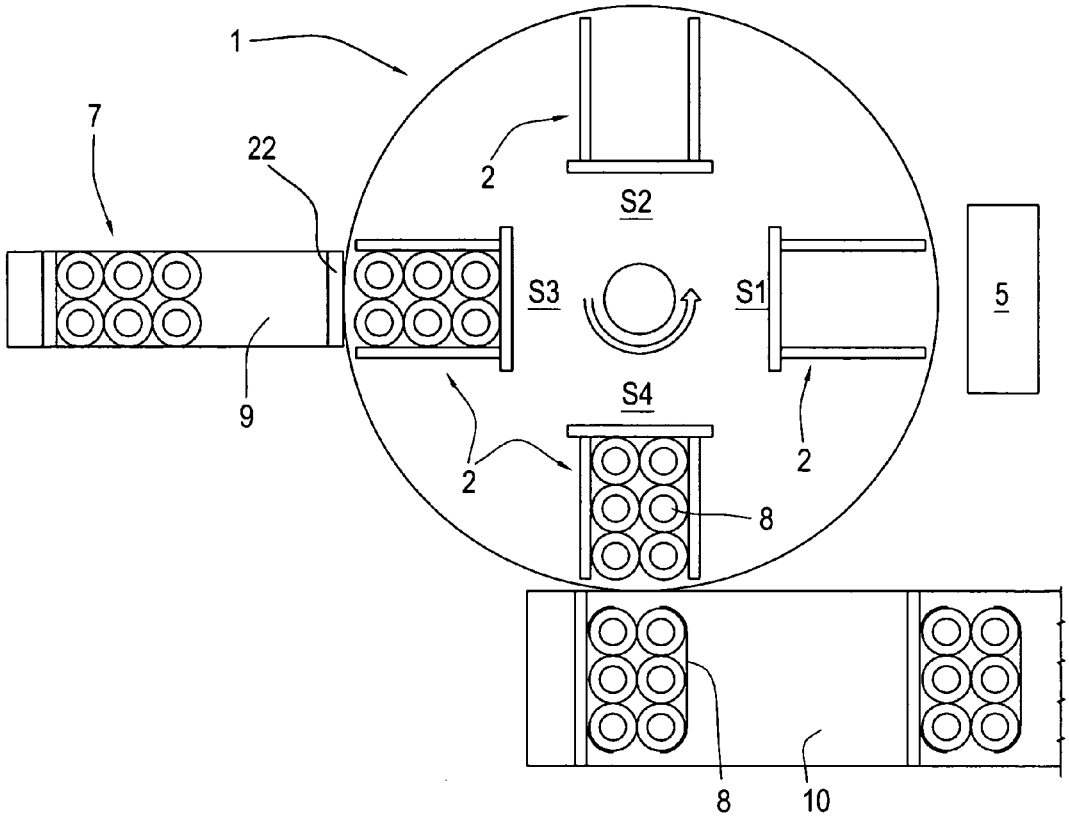
FIG. 1 is a schematic top view of a machine according to the invention.

With reference to the accompanying drawings, a machine according to the invention for wrapping groups of products 7 in tubular lengths stretch film 4 comprises a rotating carousel structure 1 mounted on a base B on a rack 16 which may be rotationally driven about a vertical axis by a motor M1 connected to the rack 16 by a toothed belt 17.

In one possible embodiment, the carousel is driven by a brushless motor which acts on the belt 17.

Advantageously, this improves the adaptability of the machine since the start-stop motion of the carousel can be varied according to the size of the products to be wrapped.

In another embodiment, the brushless motor and belt drive system might be substituted by an inverter device controlling a kinematic chain consisting of an intermitter meshed directly with rack through a gear.

This embodiment is less adaptable but simpler and more rigid, which means it may be preferable when the machine is always used for products of the same type and size.

The carousel is equipped with two or more wrapping units 2 (in the embodiment being described there are four of them but in other embodiments there may be a different number of them, such as for example, three) which rotate as one with the carousel and are preferably spaced at equal angular intervals of 90° around the circumference of the carousel 1.

The unit 5, shown in FIG. 1 but not described in detail because it does not as such form part of the invention, may be of the type capable of forming tubular film lengths either from continuous roll-fed plane webs of film that are cut and sealed to form individual tubes, or from a continuous film that is already tubular in shape and must be simply cut into the required lengths.

In both cases, the unit 5, after forming the tubular film length 4, feeds the length of film to the wrapping unit 2 at the station S1.

The unit 5 preferably comprises suction cups for holding the film and transferring the lengths 4 radially from the unit 5 to the wrapping unit 2.

For example, the unit 5 comprises a transfer unit having arms equipped with suction cups which pick up the length of film from the unit 5 and fit it on the stretch bars at the feed station, in synchrony with the rotation of the carousel.

It will, however, be understood that the system for feeding the lengths of film may be of a different type.

With reference in particular to FIG. 1, a machine according to the invention further comprises:

a station (S1) for feeding the lengths of tubular film 4 to the carousel 1;

a station (S2) for fully stretching the tubular film lengths 4 to size;

a station (S3) for placing the lengths of tubular film 4 around respective groups of products 7 to be wrapped fed one after the other by a conveying device such as a conveyor belt 9; and a station (S4) for unloading the wrapped packages 8, which contain the product groups, from the carousel onto another conveying device such as a conveyor belt 10.

Advantageously, the steps of feeding each tubular film length 4, stretching the film, loading the products 7 and unloading the wrapped packages 8 are performed simultaneously at the respective stations S1–S4 during the stops in the intermittent rotation of the carousel 1.

Figure 3B:
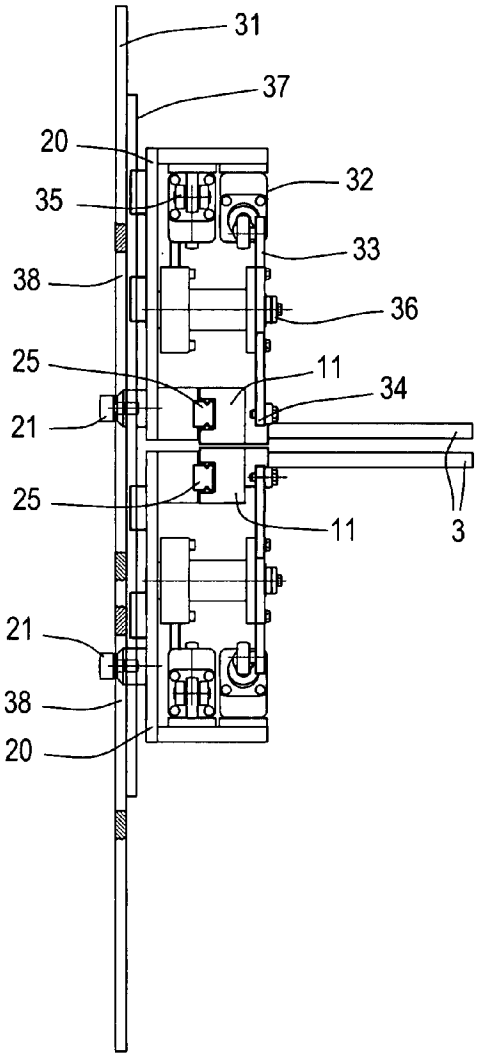
FIGS. 3*a* and 3*b* are, respectively, a front view and a side view, with some parts cut away for clarity, schematically illustrating details of the film length stretching units of the machine according to the invention.
Figure 3A:
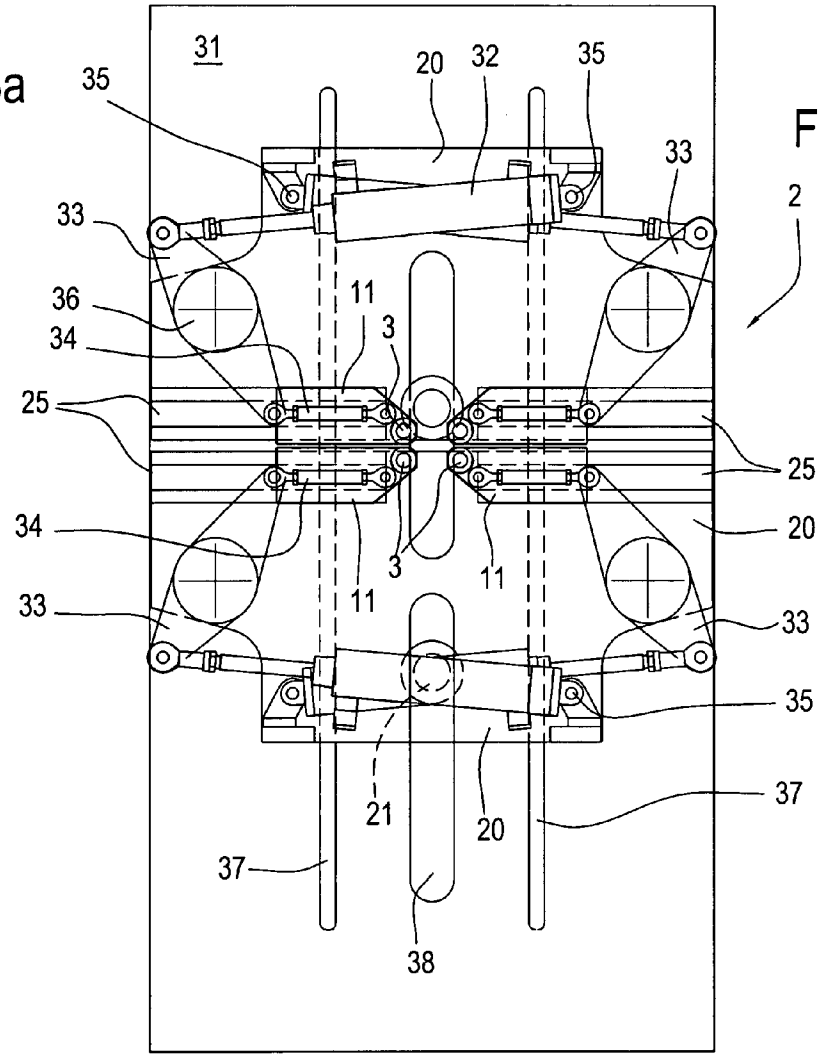

One of the wrapping units 2 mounted on the carousel 1 will now be described in greater detail with reference in particular to FIGS. 3*a* and 3*b*.

Figure 1A:
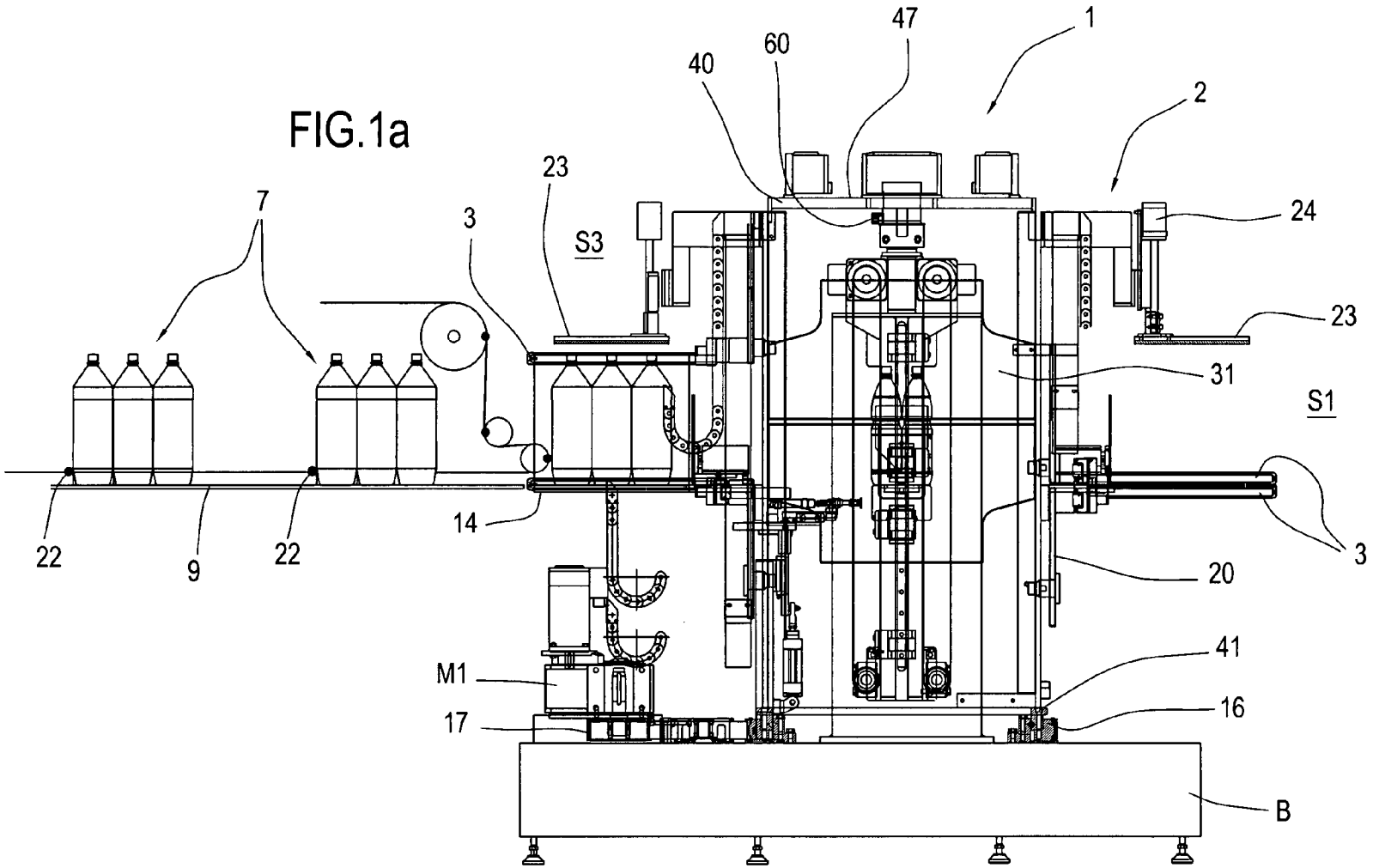
FIG. 1*a* is a side view of the machine according to the invention.

The wrapping units 2 are each preferably equipped with a plate 31 connected at the top and bottom by a cross 40 and a ring-shaped base 41 together forming a drum 47 (shown in FIG. 1*a*) that turns on the rack 16.

Looking in more detail, the base 41 constitutes a support on which the drum 47 is built, whilst the plates 31 are connected by gussets or reinforcements and corner pieces, not illustrated, while the upper cross 40 joins the top of the drum 47 and acts as a counter-rotating element for a rotary power supply distributor 60.

Two carriages 20 can run up and down on the plates 31 along vertical guides 37, each of said carriages being in turn equipped with two horizontal guides 25 positioned in line with each other, on which there run respective carriages 11, each driven by an independent actuator, preferably pneumatic.

More particularly, each actuator may consist of a pneumatic cylinder 32 attached at one end to a fixed point 35 of the respective carriage 20 and at the other end to a lever 33 pivoted on a pin 36; the lever 33 being connected at its opposite end to a connecting rod 34 that drives the carriage 11.

With this configuration, the two carriages 20 respectively support the upper and lower pairs of the four stretch bars 3, whilst the horizontal motion of each of the bars 3 may be independent and follows the respective carriage 11.

More specifically, the movement of the individual carriage 11 is controlled by a position detector preferably at least consisting of a sensor mounted on the carriage 11 and which detects a signal while moving along a magnetic bar fixed to the carriage 20. This signal is then passed to an electronic system that converts it into a value representing the position of the carriage on the guide 25.

It will be understood that other means might be used for the same purpose in addition to or in combination with the above. Thus, there might be a numeric control system to follow and control the movement of the carriages 11 using, for example, an optical system (encoder) mounted at the fulcrum of the lever 33 and designed to read the rotations of the lever and hence the movement of each carriage 11.

By reading the positive or negative increment of the signal, it is possible to calculate the movement of each carriage 11 and, hence, of each bar 3, thus making it possible to detect the reciprocal position of each pair of bars 3 mounted on the carriage 20.

The electrical signal detected in this way is also used to control the pneumatic actuator 32 by stopping the piston stem when the bar 3 reaches the predetermined position.

Since both the control systems and the drive systems of the individual bars 3 are independent of each other, it is possible to create many different configurations, even non symmetrical ones, depending on the geometry of the products to be wrapped or on the properties of the film used, in order to optimize both the power required to stretch the film and the mechanical behavior of the film after being stretched.

Figure 2B:
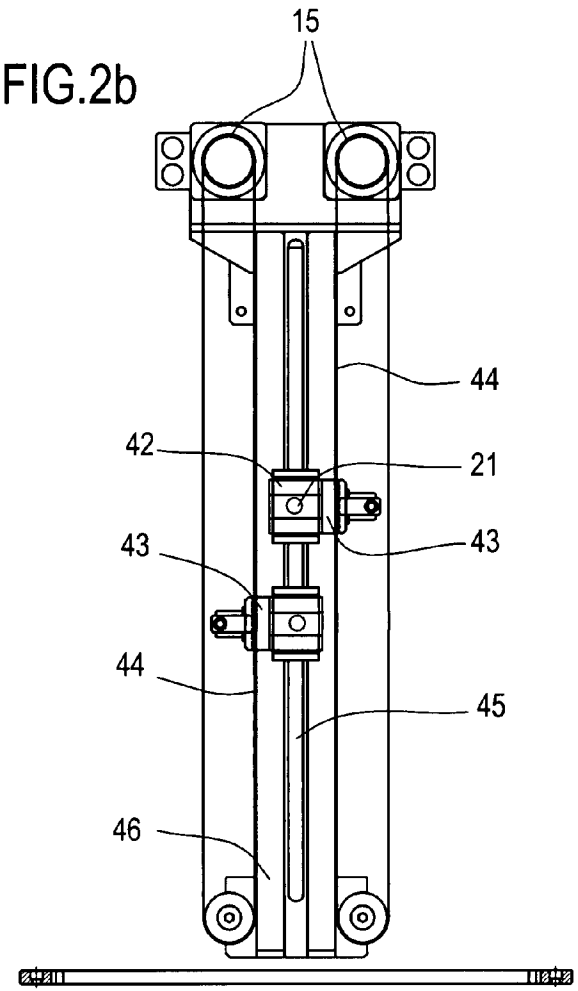
FIGS. 2*a* and 2*b* are, respectively, a side view and a front view (with some parts cut away for clarity) of a detail of the film length stretching station in the machine according to the invention.
Figure 2A:
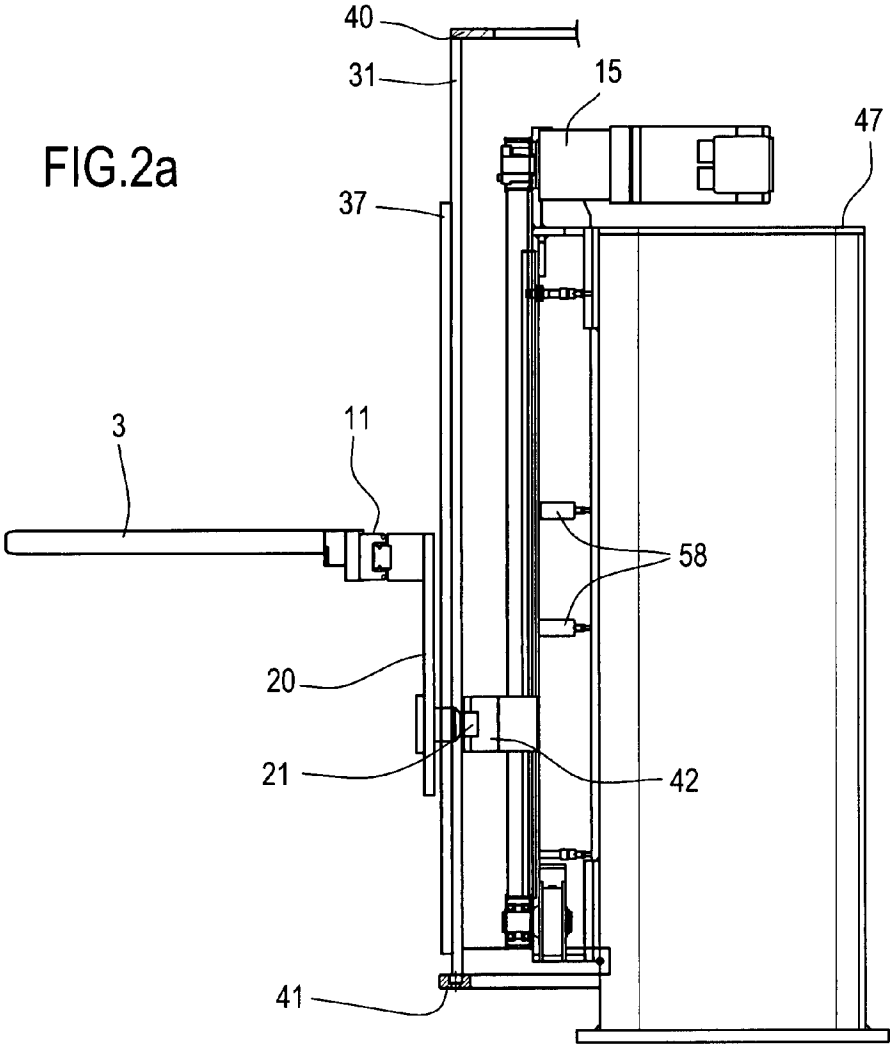

The following is a description, with reference to FIGS. 2*a* and 2*b*, of the system for vertically driving the stretching bars 3 of a wrapping unit 2 at the machine's stretching station S2.

As stated above, the bars 3 are mounted in pairs on two vertically mobile carriages 20 equipped with two pins 21 that slide in slots 38 in the plates 31.

In the configuration illustrated in FIGS. 2*a* and 2*b*, the pins 21 can engage with matching mobile sockets 42 fixed by plates 43 to vertical toothed belts 44 driven by respective actuators 15 in such a way that they can run up and down on a straight guide 45 attached to a fixed wall 46.

Figure 11:
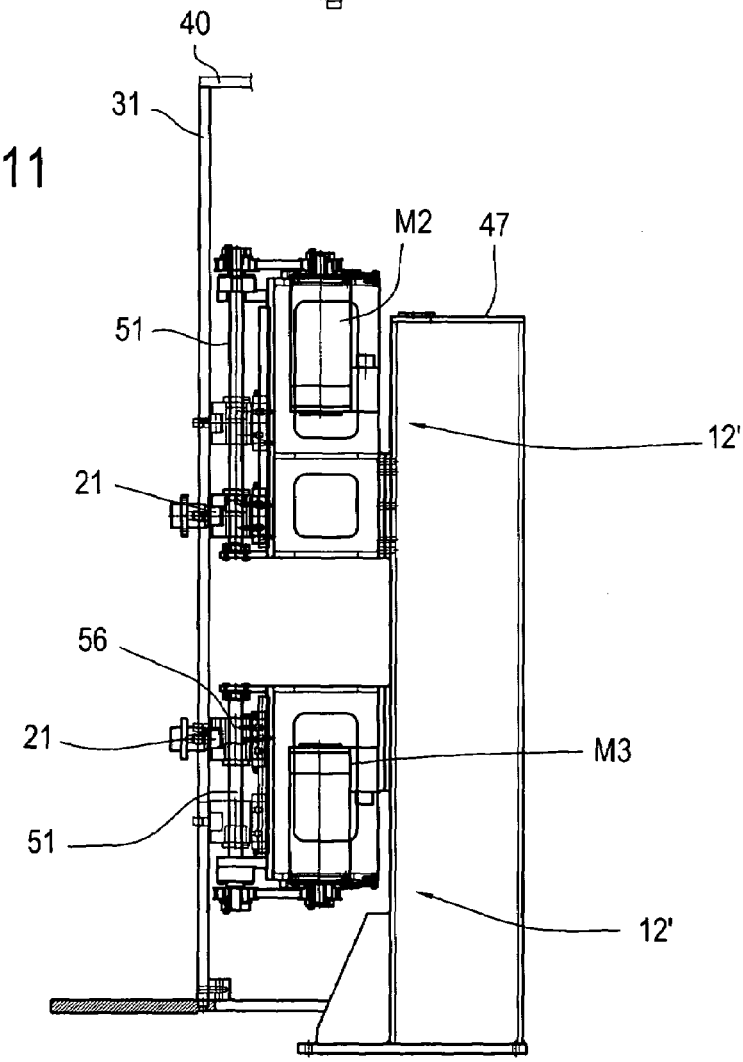
FIG. 11 shows an embodiment of the system for driving the stretch bars vertically in a machine according to the invention.

Alternatively, and with reference to FIG. 11, the vertical actuators might be linear actuators 12', consisting, for example, of two recirculating ball screws 51 mounted vertically and rotationally driven by respective motors M2, M3.

As they turn, the screws 51 cause respective lead nuts 52, each fitted with a pin 21, to move vertically so that the pins engage the vertical carriages 20.

The vertical movement of the bars 3 is also controlled by proximity sensors 58 mounted at the working positions.

Figure 4:
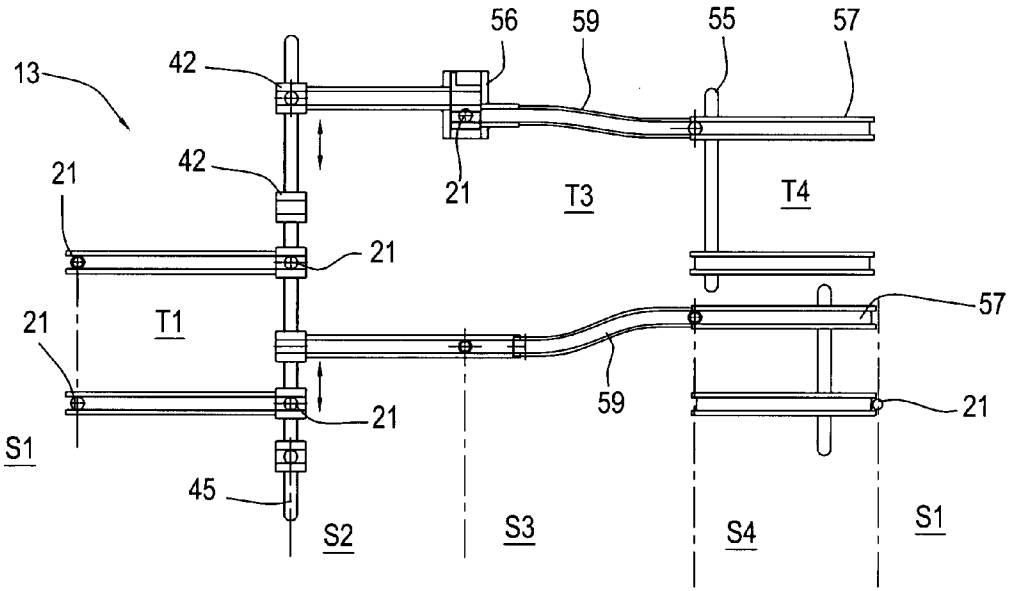
FIG. 4 schematically illustrates the linear extension of the film stretch bar guides according to the invention.

According to the invention, and with reference in particular to FIG. 4, the mobile sockets 42 form part of a set of guides, labeled 13 in their entirety, for moving the pins 21 and extending along the outer walls of a fixed turret structure 47 mounted at the center of the carousel 1, the above mentioned wall 46 forming the part of it corresponding to the stretching station S2.

Looking in more detail, with reference to the preferred embodiment being described, the set of guides 13 comprises:

a first section T1 consisting of two parallel rails extending horizontally from the feed station S1 to the stretching station S2;

a second section T2 consisting of two parallel rails extending horizontally from the stretching station S2 to the placing station S3;

a third section T3 consisting of two converging rails 59 with curved profiles and extending from the placing station S3 to the unloading station S4;

a fourth section T4 consisting of two horizontal rails 53 extending from unloading station S4 to the film feed station S1 and able two move vertically by means of vertical actuators.

Figure 4A:
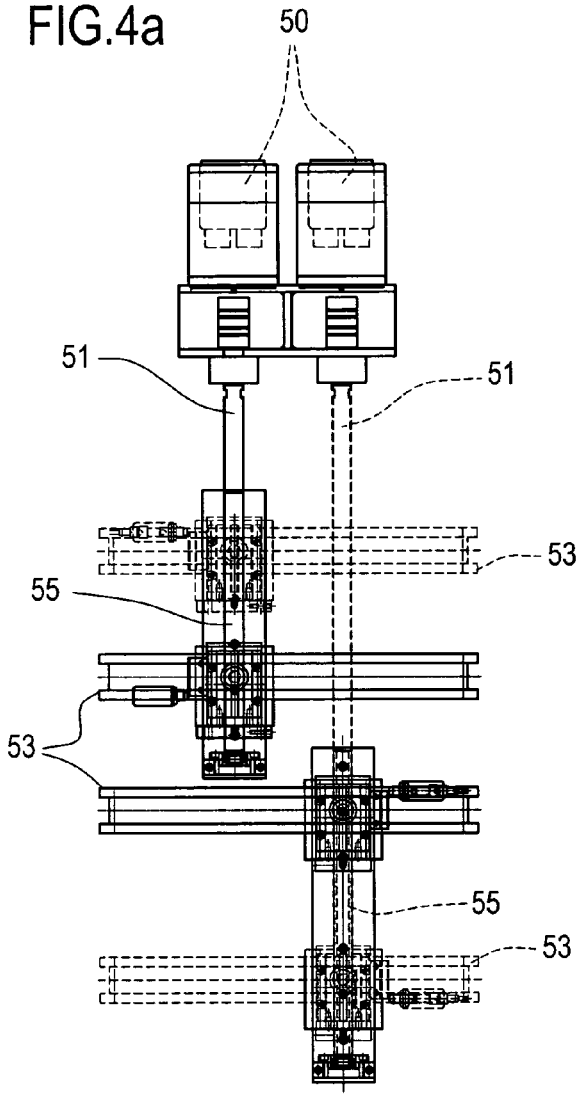
FIGS. 4*a* and 4*b*, schematically illustrate details of the horizontal rails of the guides according to the invention.
Figure 4B:
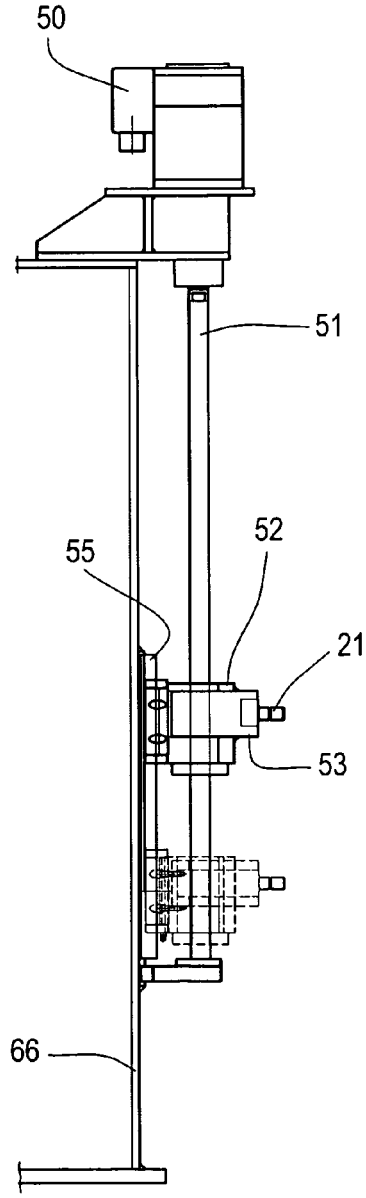

Looking in more detail with reference in particular to FIGS. 4*a* and 4*b*, the rails in the section T4 can be moved vertically by a pair of screws, which are driven by independent motors 50 and which engage with matching lead nuts 52, the latter being attached to the rails 53 and slidable on vertical guides 55 fixed to a wall 66 of the fixed turret 4.

Figure 5:
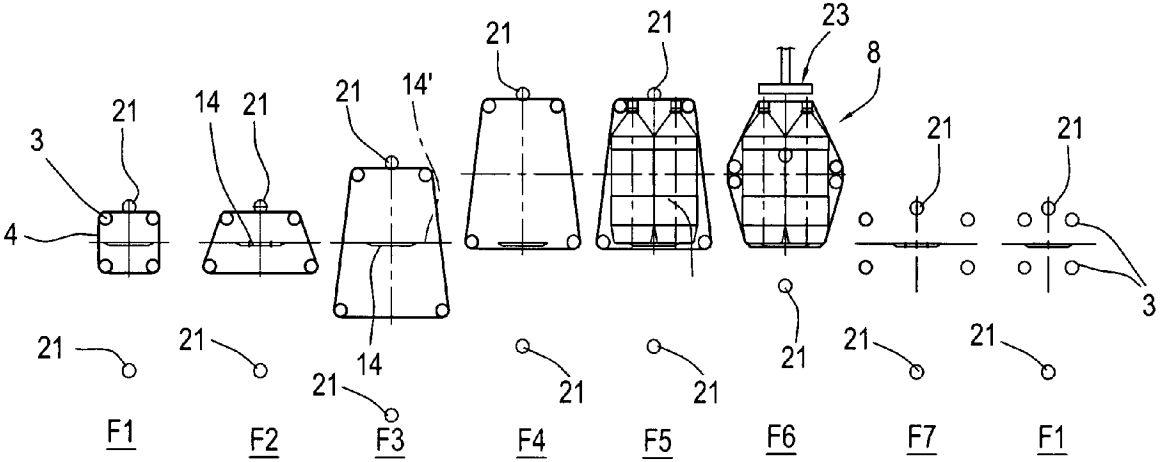
FIG. 5 schematically represents all the movements performed by the stretch bars, viewed from the front, during the successive steps of stretching, positioning and shrinking the lengths of stretch film in a machine according to the invention.

Described below with reference to FIGS. 4 and 5 are the positions adopted by the stretch bars 3 in the successive operating steps.

During the initial step F1 of feeding the length of film 4 by the unit 5, the bars 3 are positioned at the station S1 at a distance from each other such that they can receive the film length 4 and then move apart slightly so that they can hold the film securely while they are moved in a horizontal direction by the actuators acting on the carriages 11.

During the next step F2 of transfer from the station S1 to the stretching station S2, each unit 2, again by means of the horizontal actuators, starts stretching the film 4 in horizontal direction until it is at least as wide as the group of products to be wrapped.

During this step, the pins 21 of the carriages 20 are engaged by the fixed horizontal section T1 of the guide set 13 and are therefore prevented from moving vertically.

Advantageously, as mentioned above, the bars 3 are independent of each other so that the lower pair of bars 3 may, depending on the geometry of the products to be wrapped, be moved apart by an amount greater or smaller than the upper pair of bars 3 (in the example shown in FIG. 5, they are further apart).

At the stretching station S2, the carousel 1 stops and, during this stop, the vertical actuators 15 fully stretch the tubular film lengths 4 to size (step F3).

During this step, the pins 21 are engaged in the mobile sockets 42 guided by the vertical guides 45 and driven by the actuators 15.

The actuators 15 preferably operate on the upper and lower pairs of bars 3 symmetrically in such a way as to stretch the film uniformly about a central geometrical plane 14'.

The film length continues to be stretched at the station S2, with the carousel stationary, until it reaches the required size, after which (step F4, FIG. 5) stretching stops and the film length 4 is centered, again under the action of the actuators 15, with the pins 21 still engaged in the mobile sockets 42 in such a way as to create an opening of size and position corresponding to the group 8 to be loaded for wrapping on the table 14.

Advantageously, according to the invention, the vertical stretching means are fixed at the stretching station S2 where most of the stretching operation is carried out, thus concentrating the power required for stretching and reducing the weight to be carried by the carousel.

Advantageously, the actuators 32/15 that cause the film to be stretched are controlled electronically so that the stretching of the film by suitable laws of motion can be optimized according to film properties so as to avoid tearing and irregular thickness (stretching controlled in terms of speed and position).

According to another advantageous feature of the invention, the bars 3 consist of idle rollers, preferably covered with non-stick material.

Thanks to this feature, the film is stretched in particularly even fashion, minimizing the risk of tearing and deformation of the film lengths.

Further, in order to make all the bars 3 turn in the same way during stretching, suction cups are provided to apply a sideways pulling action on the film length in such a way as to create surface friction between the film and the rollers at least at the moment stretching starts, thus forcing all the rollers to turn and preventing the length of film from being stretched non-uniformly.

Advantageously, the suction cups prevent individual idle rollers from sticking which, besides causing the film to be distributed evenly, also makes it possible to center any images printed on the film itself.

The suction cups prevent the film from rotating relative to the rollers as a result of the stretching action, keeping the sealing line in a fixed position, for example always under the loading table and centered in relation to the products.

Figure 10:
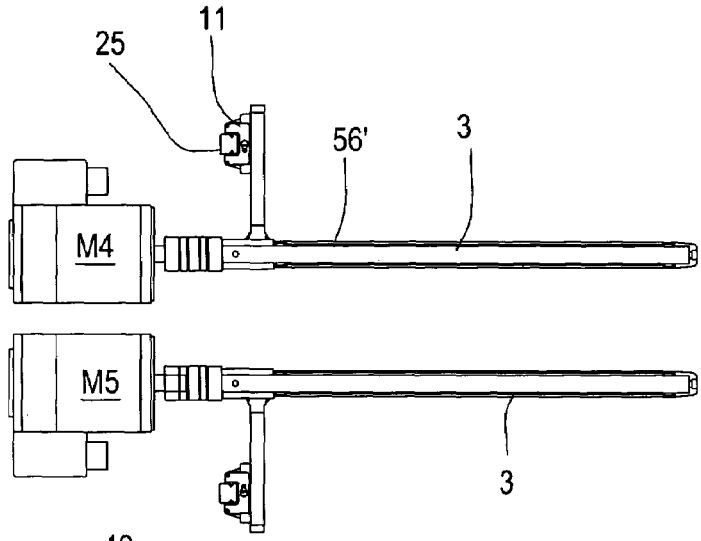
FIG. 10 shows an embodiment of the stretch bars in a machine according to the invention.

Alternatively, with reference to the configuration illustrated in FIG. 10, to stretch the film evenly and keep the printing on the film centered, it is possible to force the rotation of the rollers by driving them individually with motors M4, M5, or transmitting the motion, for example, by means of a rack and pinion system that rotates the rollers while the two carriages 20 are driven at the station S2.

Figure 8:
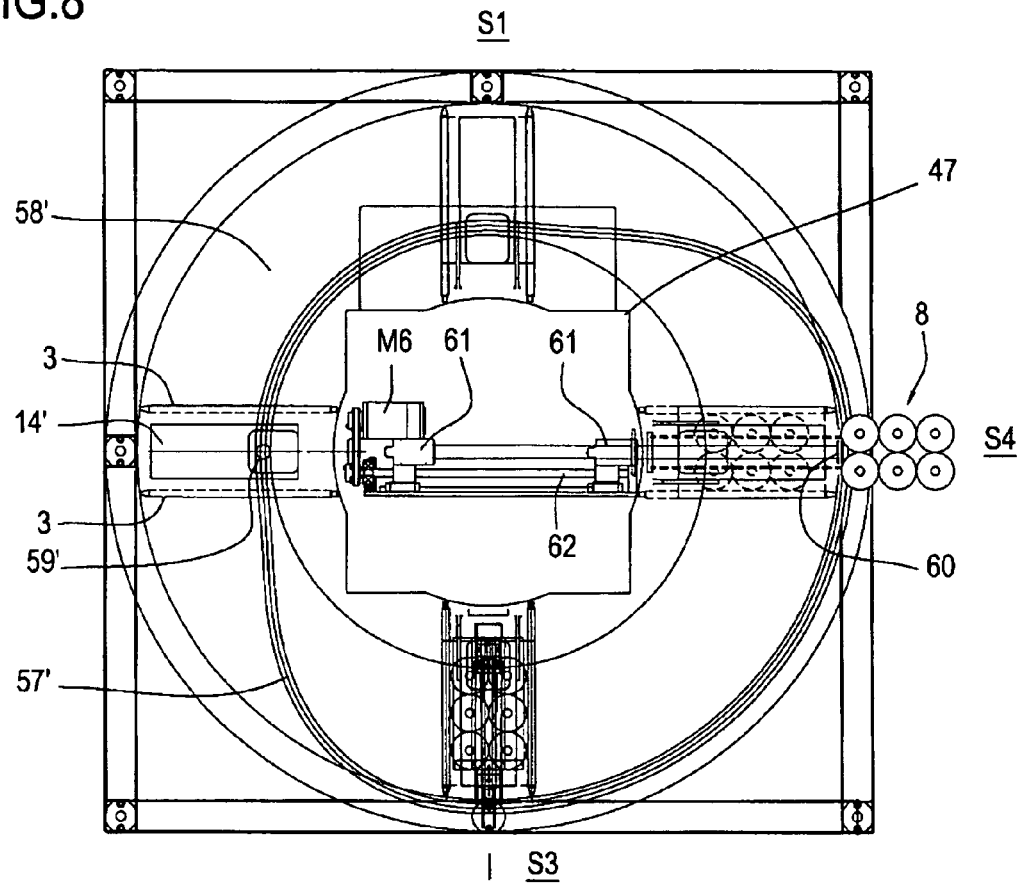
FIGS. 8 and 9 are, respectively, a plan view and a front view schematically illustrating the product loading table in one embodiment of the invention.
Figure 9:
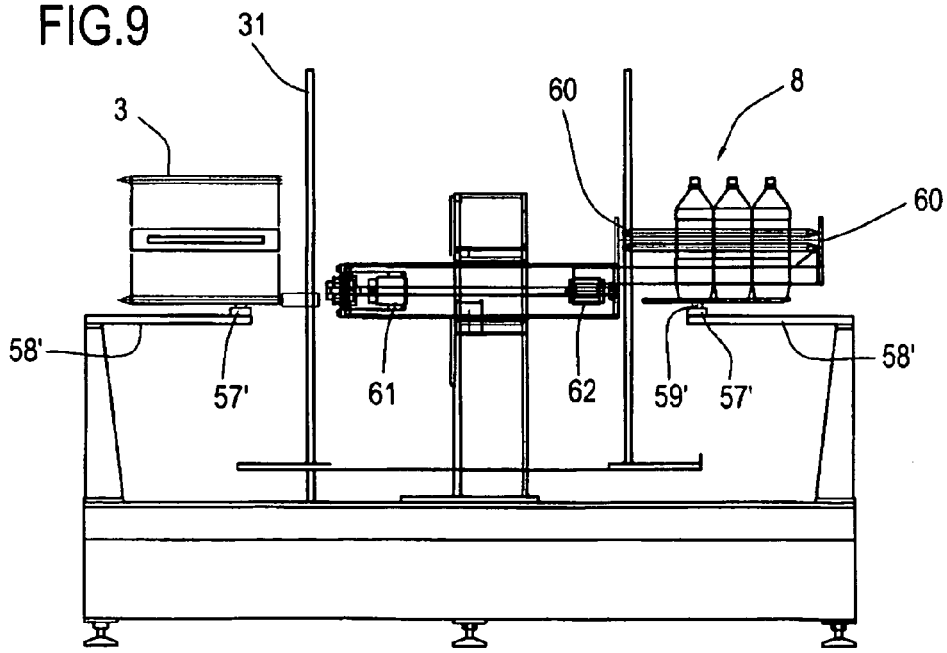

With reference to FIGS. 8 and 9, the centering step F4 may be dispensed with by providing a loading table 14 that can move to and fro between a retracted position within the radial dimensions of the bars 3, corresponding to the feed station S1 and the stretching station S2, and an advanced position corresponding to the loading and unloading positions at the stations S3, S4.

More specifically, the to and fro movement of the table 14 may be achieved by a fixed flat cam 57' which is located on a supporting surface 58' and which engages with a pin 59' on the underside of the table 14 so that the latter follows the cam profile as the carousel 1 rotates.

In this case, the table is out of the way when the film is being fed so that pins, without the interference of the table 14, can be closer together. The table 14 only appears when the product is loaded.

Since there is more space inside the carousel, a pusher 60 for unloading the packages 8 from the carousel! may be provided, mounted in the column 47 and driven by a linear actuator, for example of the type with a lead nut 61, attached to the pusher and moved by a recirculating ball screw 62 powered by a motor M5.

Once the film length 4 has been centered (step F4), the carousel 1 continues rotating until the film length 4 is positioned at the station S3 where the groups of products 7 are placed inside the film length 4 (step F5).

During this step, the pins 21 are engaged by the fixed horizontal section T2 of the guide set 13.

Preferably, in the embodiment described, the feeding of the product groups 7 is accomplished by a belt 9 equipped with pushers 22 designed to push the groups 7 on the loading table 14 into the waiting film length 4, but it will be understood that equivalent feed means of a different type might also be used.

Advantageously, in the preferred embodiment described, applied to bottles 7, the bars 3 are positioned in such a way as to guide the bottles, which are narrower at the top, into the film length 4.

At the station S3, upon completion of the step F5 of feeding the products 7 and after the group 8 has been inserted into the film length 4, the pin 21 which controls the vertical movement of the upper pair of bars 3, enters a vertical sector and moves down by a predetermined amount such as to make the film 4 come into contact with the top surface of the group of products 7.

This starts compacting the package 8 so that the products are stable and held firmly together when the carousel 1 starts rotating again.

During the same step, presser plates 23, which move as one with the units 2 and are driven vertically by the actuators 24, may be used to move down onto the package 8 in such a way as to further stabilize it while it is being transferred to the unloading station.

During the subsequent rotation of the carousel 1 from the placing station S3 to the unloading station S4, the pins 21 are engaged in the converging section T3 of the set of guides 13 so that the bars 3 follow the profile T3 of the guides 13, thus moving closer together until they reach a position where they are extracted from the package 8 (step F6) at the unloading station S4.

At the station S4, the carousel stops and the package 8 is unloaded from the carousel onto a conveyor 10 by an ejection element that is not described in detail because it is of customary type.

After unloading at the station S4, the carousel 1 starts rotating again and the pins 21 are engaged in the mobile horizontal sectors 57 of the section T4 of the set of guides 13 and are moved by the actuator 50 along the vertical guides 55 (step F7) so that the bars 3 move closer together in the vertical direction until they are once again centered relative to the loading table 14 and at the height they started from in step F1.

Next, the bars 3, driven by the carriages 11, move closer together also in the horizontal direction and return to the feed station S1 to the position they started from in step F1, ready to receive the next film length 4 when the carousel 1 next stops.

In another embodiment of the invention, the set of guides 13 is designed not only to guide the movement of the carriages 20 but also to cause their vertical movement, either substituting or acting in conjunction with the actuators 15.

In this case, the pins 21 of the carriages 20 are constrained by the rotation of the carousel 1 to follow the profile of the fixed guides 13, thus driving the bars 3 with the film length 4 on them, and either produce the sole vertical stretching action or contribute to the stretching action.

Advantageously, this solution is particularly useful for small sized products that require less stretching power and makes it possible to eliminate at least the vertical actuators, or reduce their number, thus simplifying and further lightening the machine structure.

Figure 6:
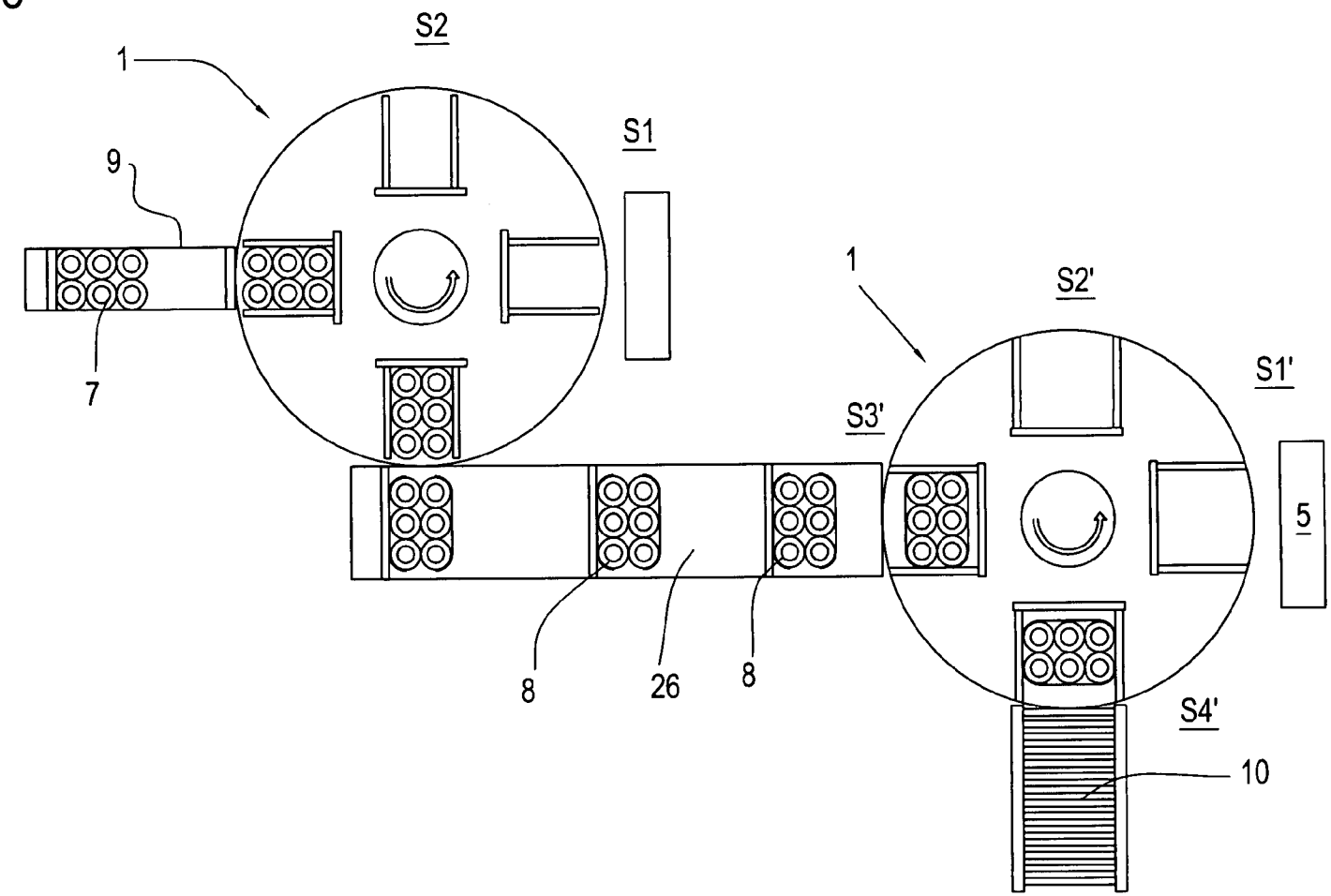
FIG. 6 is a schematic plan view of a twin-carousel embodiment of the machine according to the invention.

The embodiment of the invention illustrated in FIG. 6 is an installation for wrapping groups of products in lengths of tubular film comprising an additional machine 1' of the type described above connected by a conveyor belt 26 to a machine 1 operating in the manner described above.

The conveyor 26 transfers to the placing station S3' of the second machine 1' a succession of packaged groups 8 that are turned about a vertical axis by 90° relative to the position in which they were fed to the placing station S3 of the first machine 1.

This embodiment advantageously applies the tubular film lengths to the products in crossed fashion.

In the configuration shown in FIG. 6, the two carousels are set at 90° so that the direction of the packages 8' feeding out of the second carousel is at right angles to the direction of the groups of products 7 fed into the first carousel.

Advantageously, the two carousels might also be arranged in such a way as to create an in line configuration, for example by using a differently oriented conveyor 10 or by changing the direction of rotation of the carousels so as to change the relative position of the stations.

Figure 7:
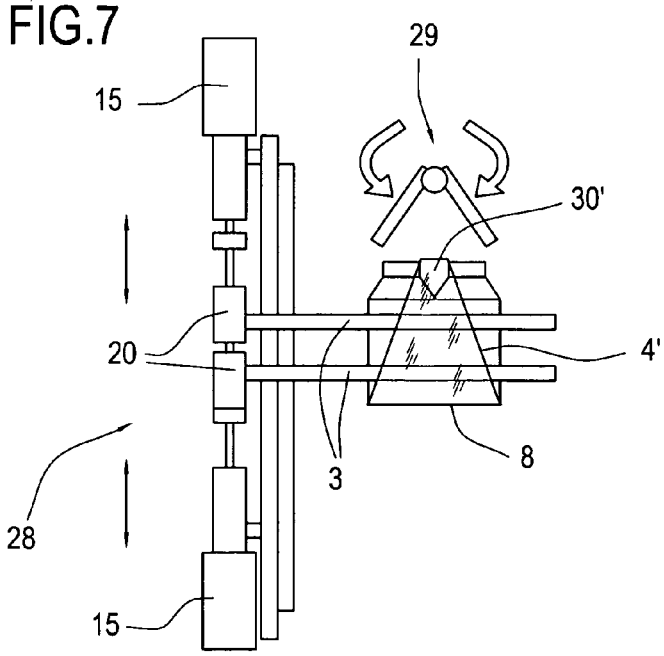
FIG. 7 schematically illustrates a handle forming unit applicable to the second carousel of the machine of FIG. 6.

In FIG. 7, the station S1' for feeding the product packages 8 to the second machine 1' may comprise a unit 28 for forming a handle from the upper portion of the second film length 4'.

More specifically, the unit 28 is equipped with a gripper 29 which, after the package 8 has been inserted into the film length 4' and before, or at the same time as, this film length is allowed to shrink onto the package 8, grips the top portion of the film length 4' and gathers it up like a strap.

Friction causes the film to remain in the gathered up state on the surface of the upper bars 3, thus forming a handle 30 by which the pack can be carried.

This specification refers to the wrapping of generic products 7.

According to the invention, however, the movements of the bars 3, guided by the guides 13 or driven directly by the actuators 15 can be varied in order to make the most of the shape and size of the products to be wrapped.

For example, when the groups of products 7 consist of rows of bottles, the tapering geometry of the bottle necks forms a cavity between the two rows of bottles which makes it easier to create a handle 30 that is easy to grip (FIG. 7).

Further, during the steps of placing the groups 7 and/or 8 into the film lengths 4 and/or 4' and in the subsequent step of shrinking the stretch film, the bars 3 may follow at least part of the outer profile of the product groups so that the film adheres better to the products and thus improving the stability of the packages.

The invention described has evident industrial applications and may be subject to modifications and variations without thereby departing from the scope of the inventive concept. Moreover, all the details of the invention may be substituted by technically equivalent elements.

What is claimed is:

1. A machine for wrapping groups of products (7) with lengths of tubular stretch film (4), comprising:

a rotating carousel (1) equipped with a plurality of wrapping units (2) having bars (3) for stretching to size a succession of tubular film lengths (4);

said carousel rotating each wrappping unit to a plurality of stations including:

a receiving station (S1) where the wrapping unit receives the film lengths;

a placing station (S3) where the wrapping unit places the stretched lengths of tubular film (4) around respective groups of products (7) to be wrapped, wherein the groups of products are fed one after the other to the placing station (S3);

an unloading station (S4) where the wrapping unit unloads the wrapped groups of products (8) from the carousel (1);and a dedicated stretching station (S2) where the wrapping unit stretches the film lengths (4), and wherein the bars (3) at least completing the stretching of the film lengths (4) at said dedicated stretching station (S2).

2. The machine according to claim 1, wherein the dedicated station (S2) is equipped with actuators (15) that drive the bars (3) until the film lengths (4) have been fully stretched to size, the actuators (15) being fixed relative to the rotating carousel (1).

3. The machine according to claim 1, further comprising first and second actuators (15, 32) for driving the bars (3) independently in the vertical and horizontal directions.

4. The machine according to claim 3, wherein the vertical actuators (15) for driving the bars vertically are positioned in such a way as to drive the bars (3) symmetrically about a horizontal plane (14').

5. The machine according to claim 4, wherein the horizontal plane (14') coincides with a table (14) for loading/unloading the groups of products (7).

6. The machine according to claim 3, wherein the actuators (32) for driving the bars (3) horizontally are mounted on wrapping units (2).

7. The machine according to claim 3, further comprising encoder devices for controlling the actuators (32, 15).

8. The machine according to claim 3, wherein each wrapping unit (2) comprises four independent horizontal actuators (32) acting on four mobile carriages (11) arranged in pairs running on horizontal guides (25) made on two vertically mobile carriages (20), each carriage (11) being equipped with a stretch bar (3).

9. The machine according to claim 8, further comprising means for detecting the position and movements of each mobile carriage (11) in such a way as to detect the reciprocal position of each pair of bars (3) mounted on the respective carriage (20).

10. The machine according to claim 1, wherein the carousel (1) comprises a set of guides (13) comprising one or more sections (T1–T4) positioned around at least part of the circumference of the carousel (1) for guiding the movement of the bars (3) as the carousel (1) rotates.

11. The machine according to claim 10, wherein each of the mobile carriages includes a pin, and wherein, at the dedicated stretching station (S2), the set of guides (13) comprises one or more vertically mobile sectors (57) for receiving the pins (21) on the carriages (20) and which are driven by vertical actuators (15) in such a way as to move the bars (3) vertically and thereby stretching the length of film (4).

12. The machine according to claim 10, wherein each of the mobile carriages includes a pin, and wherein the set of guides (13) comprises at least one section (T3) comprising one or more cam profiles (59) for receiving the pins (21) on the carriages (20) in order to guide the vertical movement of the bars (3) according to one or more predetermined paths.

13. The machine according to claim 12, wherein the cam section (T3) is arranged in a such a way as to move the bars (3) towards each other and thereby guiding the film length (4) as it shrinks on the group of products (7) to be wrapped.

14. The machine according to claim 10, wherein the set of guides (13) comprises at least one section (T4) comprising sectors (57) that are driven vertically by motors (50).

15. The machine according to claim 10, wherein the guides (13) are designed to actively drive the bars (3) and exert a stretching force on the film length (4) as the carousel (1) rotates.

16. The machine according to claim 1, wherein each of the bars (3) comprise an idle roller.

17. The machine according to claim 16, wherein each of the idle rollers is covered with non-stick material.

18. The machine according to claim 1, wherein each of the bars (3) comprises a power-driven roller (56).

19. The machine according to claim 1, wherein the dedicated stretching station (S2) comprises suction cups acting on the film in such a way as to temporarily hold the film as it starts being stretched, thus avoiding undesired movements of the film and uneven stretching of the film length (4).

20. The machine according to claim 1, further comprising pusher means (22) for feeding groups of products (7) to the placing station (S3) and pusher and/or extractor means for unloading the packages (8) from the carousel (1).

21. The machine according to claim 1, further comprising stabilizing plates (23) acting on the tops of the groups of products (7) while they are being placed in a film length (4) and/or on the wrapped groups of products (8) while they are being transferred from the placing station (S3) to the unloading station (S4).

22. The machine according to claim 1, wherein the groups of products are fed one after the other to the placing station (S3) by a product loading table (14) that moves to and fro between a retracted position and an advanced position corresponding to the loading position.

23. The machine according to claim 22, wherein the to and fro movement of the table (14) is achieved by a fixed flat cam (57') which is located on a supporting surface (58') and which engages with a pin (59') on the underside of the table (14) so that the table follows the fixed flat cam profile as the carousel (1) rotates.

24. An installation for wrapping groups of products in tubular lengths of stretch film (4) comprising a first and a second machine for wrapping groups of products (7) with lengths of tubular stretch film (4) according to claim 1, wherein the carousels are connected by a conveyor belt (26) that feeds the carousel (1') of the second machine with a succession of groups of wrapping products (8) unloaded from the first carousel (1) of the first machine, the groups of wrapped products (8) being transferred by the conveyor (26) to the placing station (S3') of the second carousel (1') in a position that is turned about a vertical axis by 90° relative to the position in which the groups of the products were fed to the placing station (S3) of the first carousel (1), so that groups of products (7) are wrapped in two tubular film lengths (4, 4') in crossed fashion.

25. The installation according to claim 24, wherein the placing station (S3') of the second carousel (1') comprises a unit (28) for making a handle comprising a portion of a film length (4').

26. The installation according to claim 25, wherein the handle making unit (28) is equipped with a gripper (29) that grips the top (30) of the film length (4') and gathers the top of the film length up like a strap forming a handle by which the pack can be carried.

* * * * *